US010720300B2

(12) United States Patent
Rommel et al.

(10) Patent No.: US 10,720,300 B2
(45) Date of Patent: Jul. 21, 2020

(54) X-RAY SOURCE FOR 2D SCANNING BEAM IMAGING

(71) Applicant: American Science and Engineering, Inc., Billerica, MA (US)

(72) Inventors: Martin Rommel, Lexington, MA (US); Jeffrey R. Schubert, Somerville, MA (US)

(73) Assignee: American Science and Engineering, Inc., Billerica, MA (US)

( * ) Notice: Subject to any disclaimer, the term of this patent is extended or adjusted under 35 U.S.C. 154(b) by 160 days.

(21) Appl. No.: 15/719,689

(22) Filed: Sep. 29, 2017

(65) Prior Publication Data

US 2018/0286624 A1 Oct. 4, 2018

Related U.S. Application Data

(60) Provisional application No. 62/402,102, filed on Sep. 30, 2016.

(51) Int. Cl.

| | |
|---|---|
| ***H01J 35/30*** | (2006.01) |
| ***H01J 35/14*** | (2006.01) |
| ***G21K 1/04*** | (2006.01) |

(52) U.S. Cl.
CPC ..... *H01J 35/30* (2013.01); *H01J 35/14* (2013.01); *G21K 1/043* (2013.01)

(58) Field of Classification Search
CPC ..... H01J 35/30
USPC ..... 378/137
See application file for complete search history.

(56) References Cited

U.S. PATENT DOCUMENTS

| | | | |
|---|---|---|---|
| 3,678,278 | A | 7/1972 | Peil |
| 3,780,291 | A | 12/1973 | Stein |
| 3,790,799 | A | 2/1974 | Stein |
| 3,843,881 | A | 10/1974 | Barton |
| 3,884,816 | A | 5/1975 | Takahashi |
| 3,919,467 | A | 11/1975 | Peugeot |
| 3,924,064 | A | 12/1975 | Nomura |
| 3,961,186 | A | 6/1976 | Leunbach |
| 3,971,948 | A | 7/1976 | Pfeiler |
| 3,990,175 | A | 11/1976 | Conway |
| 4,008,400 | A | 2/1977 | Brunnett |
| 4,020,346 | A | 4/1977 | Dennis |
| 4,031,545 | A | 6/1977 | Stein |

(Continued)

FOREIGN PATENT DOCUMENTS

| | | |
|---|---|---|
| CN | 1715895 | 1/2006 |
| CN | 1764987 | 4/2006 |

(Continued)

OTHER PUBLICATIONS

International Search Report for PCT/US17/54211, dated Jan. 18, 2018.

(Continued)

*Primary Examiner* — Yara B Green
(74) *Attorney, Agent, or Firm* — Novel IP

(57) ABSTRACT

A two-dimensional X-ray scanner that includes a beam steerer for steering an electron beam to impinge upon a target; and a collimator further including an aperture adapted for travel in an aperture travel path for rotating the X-ray beam plane spanned by the electron beam impinging upon the target along a focal track for emitting a scanning X-ray beam.

14 Claims, 5 Drawing Sheets

(56) References Cited

U.S. PATENT DOCUMENTS 4,045,672 A * 8/1977 Watanabe ..... A61B 6/032 378/10
4,047,035 A 9/1977 Dennhoven
4,064,440 A 12/1977 Roder
4,070,576 A 1/1978 Cobb
4,107,532 A 8/1978 Macovski
4,112,301 A 9/1978 Annis
4,139,771 A 2/1979 Dennhoven
4,160,165 A 7/1979 McCombs
4,179,100 A 12/1979 Sashin
4,196,352 A 4/1980 Berninger
4,200,800 A 4/1980 Swift
4,228,353 A 10/1980 Johnson
4,228,357 A 10/1980 Annis
4,242,583 A * 12/1980 Annis ..... G01N 23/04 378/146
4,242,588 A 12/1980 Huang
4,260,898 A 4/1981 Annis
4,298,800 A 11/1981 Goldman
4,303,830 A 12/1981 Heinzelmann
4,342,914 A 8/1982 Bjorkholm
4,349,739 A 9/1982 Annis
4,366,382 A 12/1982 Kotowski
4,366,576 A 12/1982 Annis
4,380,817 A 4/1983 Harding
4,389,729 A 6/1983 Stein
4,414,682 A 11/1983 Annis
4,422,177 A 12/1983 Mastronardi
4,426,721 A 1/1984 Wang
4,454,605 A 6/1984 Delucia
4,472,822 A 9/1984 Swift
4,503,332 A 3/1985 Annis
4,514,691 A 4/1985 De
4,525,854 A 6/1985 Molbert
4,535,245 A 8/1985 Zonneveld
4,549,307 A 10/1985 Macovski
4,578,806 A 3/1986 Grass
4,586,441 A 5/1986 Zekich
4,598,415 A 7/1986 Luccio
4,672,837 A 6/1987 Cottrell
4,692,937 A 9/1987 Sashin
4,711,994 A 12/1987 Greenberg
4,736,401 A 4/1988 Donges
4,745,631 A 5/1988 Paolini
4,756,015 A 7/1988 Doenges
4,759,047 A 7/1988 Donges
4,768,214 A 8/1988 Bjorkholm
4,783,794 A 11/1988 Dietrich
4,799,247 A 1/1989 Annis
4,807,637 A 2/1989 Bjorkholm
4,809,312 A 2/1989 Annis
4,817,121 A 3/1989 Shimizu
4,819,256 A 4/1989 Annis
4,821,023 A 4/1989 Parks
4,825,454 A 4/1989 Annis
4,839,913 A 6/1989 Annis
4,841,555 A 6/1989 Doi
4,845,769 A 7/1989 Burstein
4,864,142 A 9/1989 Gomberg
4,870,670 A 9/1989 Geus
4,884,289 A 11/1989 Glockmann
4,890,310 A 12/1989 Umetani
4,893,015 A 1/1990 Kubierschky
4,894,619 A 1/1990 Leinonen
4,899,283 A 2/1990 Annis
4,961,214 A 10/1990 Van
4,974,247 A 11/1990 Friddell
4,979,137 A 12/1990 Gerstenfeld
4,995,066 A 2/1991 Harding
5,007,072 A 4/1991 Jenkins
5,022,062 A 6/1991 Annis
5,033,073 A 7/1991 Friddell
5,038,370 A 8/1991 Harding
5,039,981 A 8/1991 Rodriguez
5,044,002 A 8/1991 Stein
5,084,619 A 1/1992 Pfeiler
5,115,459 A 5/1992 Bertozzi
5,120,706 A 6/1992 Weeks
5,121,105 A 6/1992 Aittoniemi
5,127,030 A 6/1992 Annis
5,132,995 A 7/1992 Stein
5,156,270 A 10/1992 Kachel
5,179,581 A 1/1993 Annis
5,181,234 A 1/1993 Smith
5,182,764 A 1/1993 Peschmann
5,212,720 A 5/1993 Landi
5,224,144 A 6/1993 Annis
5,243,693 A 9/1993 Maron
5,247,561 A 9/1993 Kotowski
5,253,283 A 10/1993 Annis
5,260,982 A 11/1993 Fujii
5,313,511 A 5/1994 Annis
5,367,552 A 11/1994 Peschmann
5,394,454 A 2/1995 Harding
5,397,986 A 3/1995 Conway
5,420,905 A 5/1995 Bertozzi
5,430,787 A 7/1995 Norton
5,463,224 A 10/1995 Burstein
5,483,569 A 1/1996 Annis
5,490,218 A 2/1996 Krug
5,493,596 A 2/1996 Annis
5,503,424 A 4/1996 Agopian
5,524,133 A 6/1996 Neale
5,528,656 A 6/1996 Annis
5,572,121 A 11/1996 Beswick
5,579,360 A 11/1996 Abdel-Mottaleb
5,590,057 A 12/1996 Fletcher
5,600,303 A 2/1997 Husseiny
5,600,700 A 2/1997 Krug
5,602,893 A 2/1997 Harding
5,638,420 A 6/1997 Armistead
5,642,393 A 6/1997 Krug
5,642,394 A 6/1997 Rothschild
5,660,549 A 8/1997 Witt
5,666,393 A 9/1997 Annis
5,692,028 A 11/1997 Geus
5,692,029 A 11/1997 Husseiny
5,696,806 A 12/1997 Grodzins
5,699,400 A 12/1997 Lee
5,763,886 A 6/1998 Schulte
5,764,683 A 6/1998 Swift
5,796,110 A 8/1998 An
5,838,758 A 11/1998 Krug
5,882,206 A 3/1999 Gillio
5,892,840 A 4/1999 Jang
5,910,973 A 6/1999 Grodzins
5,930,326 A 7/1999 Rothschild
5,940,468 A 8/1999 Huang
5,966,422 A 10/1999 Dafni
5,974,111 A 10/1999 Krug
6,018,562 A 1/2000 Willson
6,044,353 A 3/2000 Pugliese
6,057,761 A 5/2000 Yukl
6,081,580 A 6/2000 Grodzins
6,094,472 A 7/2000 Smith
6,137,895 A 10/2000 Al-Sheikh
6,151,381 A 11/2000 Grodzins
6,192,104 B1 2/2001 Adams
6,212,251 B1 4/2001 Tomura
6,236,709 B1 5/2001 Perry
6,249,567 B1 6/2001 Rothschild
6,269,142 B1 7/2001 Smith
6,272,206 B1 8/2001 Bjorkholm
6,278,115 B1 8/2001 Annis
6,282,260 B1 8/2001 Grodzins
6,282,264 B1 8/2001 Smith
6,298,603 B1 10/2001 Diaz
6,301,326 B2 10/2001 Bjorkholm
6,301,327 B1 10/2001 Martens
6,308,644 B1 10/2001 Diaz
6,315,308 B1 11/2001 Konopka
RE37,467 E 12/2001 Brasch
6,366,203 B1 4/2002 Burns
6,370,222 B1 4/2002 Cornick

(56) References Cited

U.S. PATENT DOCUMENTS 6,375,697 B2 4/2002 Davies
6,393,095 B1 5/2002 Robinson
6,418,194 B1 7/2002 McPherson
6,421,420 B1 7/2002 Grodzins
6,442,233 B1 8/2002 Grodzins
6,459,761 B1 10/2002 Grodzins
6,459,764 B1 10/2002 Chalmers
6,473,487 B1 10/2002 Le
6,484,650 B1 11/2002 Stomski
6,507,278 B1 1/2003 Brunetti
6,546,072 B1 4/2003 Chalmers
6,552,346 B2 4/2003 Verbinski
6,553,096 B1 4/2003 Zhou
6,556,653 B2 4/2003 Hussein
6,567,496 B1 5/2003 Sychev
6,597,760 B2 7/2003 Beneke
6,610,977 B2 8/2003 Megerle
6,621,888 B2 9/2003 Grodzins
6,628,745 B1 9/2003 Annis
6,634,668 B2 10/2003 Urffer
6,653,588 B1 11/2003 Gillard-Hickman
6,665,373 B1 12/2003 Kotowski
6,674,367 B2 1/2004 Sweatte
6,707,879 B2 3/2004 McClelland
6,721,391 B2 4/2004 McClelland
6,742,301 B1 6/2004 Schwarz
6,745,520 B2 6/2004 Puskaric
6,749,207 B2 6/2004 Nadeau
6,754,304 B1 6/2004 Kumakhov
6,785,360 B1 8/2004 Annis
6,819,109 B2 11/2004 Sowers
6,819,241 B2 11/2004 Turner
6,839,403 B1 1/2005 Kotowski
6,848,826 B2 2/2005 Marie
6,870,791 B1 3/2005 Caulfield
6,876,719 B2 4/2005 Ozaki
6,879,657 B2 4/2005 Hoffman
6,891,381 B2 5/2005 Bailey
6,899,540 B1 5/2005 Neiderman
6,901,346 B2 5/2005 Tracy
6,911,907 B2 6/2005 Kelliher
6,952,163 B2 10/2005 Huey
6,965,340 B1 11/2005 Baharav
6,965,662 B2 * 11/2005 Eppler ..... G01N 23/04 378/25
6,967,612 B1 11/2005 Gorman
6,970,086 B2 11/2005 Nelson
6,970,087 B2 11/2005 Stis
6,990,175 B2 1/2006 Nakashima
7,053,785 B2 5/2006 Akins
7,092,485 B2 8/2006 Kravis
7,103,137 B2 9/2006 Seppi
7,110,493 B1 9/2006 Kotowski
7,110,925 B2 9/2006 Pendergraft
7,114,849 B2 10/2006 Atzinger
7,142,638 B2 11/2006 Polichar
7,162,005 B2 1/2007 Bjorkholm
7,164,747 B2 1/2007 Ellenbogen
7,185,206 B2 2/2007 Goldstein
7,203,276 B2 4/2007 Arsenault
7,257,189 B2 8/2007 Modica
7,265,709 B2 9/2007 Fleisher
7,286,634 B2 10/2007 Sommer
7,305,062 B2 12/2007 Hambuechen
7,305,063 B2 12/2007 Heuscher
7,317,785 B1 * 1/2008 Zou ..... H01J 35/04 378/12
7,330,529 B2 2/2008 Kautzer
7,333,587 B2 2/2008 De
7,356,115 B2 4/2008 Ford
7,365,672 B2 4/2008 Keller
7,400,701 B1 7/2008 Cason
7,418,077 B2 8/2008 Gray
7,460,636 B2 12/2008 Ein-Gal
7,476,023 B1 1/2009 Canfield
7,505,557 B2 3/2009 Modica
7,505,562 B2 3/2009 Dinca
7,551,709 B2 6/2009 Schlomka
7,551,715 B2 6/2009 Rothschild
7,561,666 B2 7/2009 Annis
7,593,506 B2 9/2009 Cason
7,593,510 B2 9/2009 Rothschild
7,639,866 B2 12/2009 Pomero
7,660,388 B2 2/2010 Gray
7,684,544 B2 3/2010 Wilson
7,783,004 B2 8/2010 Kotowski
7,796,394 B2 9/2010 Wang
7,796,733 B2 9/2010 Hughes
7,796,734 B2 9/2010 Mastronardi
7,806,589 B2 10/2010 Tashman
7,809,109 B2 10/2010 Mastronardi
7,817,776 B2 10/2010 Agrawal
7,826,589 B2 11/2010 Kotowski
8,135,112 B2 3/2012 Hughes
8,576,989 B2 11/2013 Kaminski
9,117,564 B2 8/2015 Rommel
9,257,208 B2 2/2016 Rommel
2002/0045152 A1 4/2002 Viscardi
2002/0094064 A1 * 7/2002 Zhou ..... A61B 6/032 378/122
2003/0012338 A1 1/2003 Lienard
2003/0171939 A1 9/2003 Yagesh
2003/0198318 A1 * 10/2003 Price ..... H01J 35/065 378/122
2003/0225612 A1 12/2003 Desimone
2003/0229506 A1 12/2003 Scott
2004/0088584 A1 5/2004 Shachar
2004/0175018 A1 9/2004 MacArthur
2005/0276379 A1 12/2005 Polichar
2006/0182223 A1 8/2006 Heuscher
2006/0262902 A1 11/2006 Wattenburg
2007/0009088 A1 1/2007 Edic
2007/0086564 A1 4/2007 Bruder
2007/0098142 A1 5/2007 Rothschild
2007/0172031 A1 7/2007 Cason
2007/0235652 A1 10/2007 Smith
2009/0041186 A1 2/2009 Gray
2009/0116614 A1 5/2009 Kotowski
2009/0116617 A1 5/2009 Mastronardi
2009/0245462 A1 10/2009 Agrawal
2009/0257555 A1 10/2009 Chalmers
2011/0017917 A1 1/2011 Mastronardi
2011/0096901 A1 4/2011 Kotowski
2011/0164726 A1 7/2011 Mastronardi
2011/0274249 A1 11/2011 Gray
2011/0274250 A1 11/2011 Gray
2011/0293072 A1 12/2011 Kaminski
2011/0299659 A1 12/2011 Gray
2012/0269324 A1 * 10/2012 Adler ..... H01J 35/08 378/138
2013/0235977 A1 * 9/2013 Grodzins ..... H01J 35/30 378/124
2014/0105367 A1 * 4/2014 Horvarth ..... H01J 35/14 378/138

FOREIGN PATENT DOCUMENTS

CN 101379415 3/2009
CN 101644687 2/2010
CN 101467071 6/2012
EP 0261984 A2 3/1988
EP 0533316 3/1993
EP 1772874 4/2007
EP 1772874 A2 4/2007
EP 2520927 A1 11/2012
EP 2548011 1/2013
EP 2548012 1/2013
WO 1988000698 1/1988
WO 2009006044 1/2009
WO 2009082762 7/2009
WO 2009082762 A1 7/2009
WO 2011115923 A1 9/2011

(56) References Cited

FOREIGN PATENT DOCUMENTS

| | | | |
|---|---|---|---|
| WO | 2011115930 | A2 | 9/2011 |
| WO | 2011115934 | A2 | 9/2011 |
| WO | 2011115935 | A1 | 9/2011 |

OTHER PUBLICATIONS

ANSI, Radiation Safety for Personnel Security Screening Systems Using X-Rays, Apr. 3, 2002.
Daniel Strom, "Screening Individuals with Backscatter X-Ray Systems", Health Physics Society, Feb. 3, 2005.
Gerald J. Smith, 'Bodysearch Technology Uses X-ray Imaging to Remove Hazards and Humiliation from Personnel Searches', IEEE, 1995.
MSNBC, "Airports Seek Hi-Tech Security", Apr. 3, 2002.
Murray et al., "Exploitation of X-Ray Technology for the Detection of Contraband-Aviation Security Applications", European Conference on Security and Detection, Apr. 28-30, 1997.
Rapiscan Security Products, Secure 1000 Brochure, 2002.
Rapiscan Security Products, Secure 1000 Concealed Object Detection System, Nov. 1998.
Rapiscan Systems Secure 1000 Case Study, London Heathrow Terminal 4, Fall 2004.

* cited by examiner

X-RAY SOURCE FOR 2D SCANNING BEAM IMAGING

CROSS-REFERENCE TO RELATED APPLICATIONS

The present specification relies on, for priority, U.S. Patent Provisional Application No. 62/402,102, entitled "X-Ray Source for 2D Scanning Beam Imaging", and filed on Sep. 30, 2016, for priority.

The above-mentioned application is herein incorporated by reference in its entirety.

FIELD

The present specification relates to apparatus and methods for scanning a beam of penetrating radiation, and, more particularly, apparatus and methods for scanning a pencil beam over an area to acquire wide field-of-view X-ray images of stationary objects without source rotation.

BACKGROUND

All practical backscatter X-ray imaging systems are raster scanners, which acquire an image pixel by pixel while moving a well-collimated X-ray beam (also referred to as pencil beam) across the object under inspection. Typically, the sweeping X-ray beam is formed by mechanically moving an aperture in a line in front of a stationary X-ray source. The line is typically a straight line, or nearly so, such that an emergent beam sweeps within a plane, over the course of time. That plane is referred to as a "beam plane." As the aperture moves along its typically linear path, a resulting X-ray beam sweeps through the system's beam plane across the imaged object, such that an image line may be acquired. An orthogonal image dimension is obtained either by moving the imaged object through the beam plane or by moving the beam plane across the imaged object.

The common conveyer-based inspection systems use the first approach (moving the imaged object through the beam plane). The latter (moving the beam plane across to the object) is suitable for stationary objects. Motion of the beam plane is typically achieved by one of two methods: The imaging system is moved linearly along the imaged object, or else the imaging system turns and thereby sweeps the beam plane over the imaged object in doing so.

A notable exception to the general practice of scanning within a beam plane and moving the beam plane relative to an object is described in U.S. Patent Application No. 20070172031 by Cason and Rothschild, incorporated herein by reference. The application discloses "a beam scanning device comprising: a. a first scanning element constrained to motion solely with respect to a first single axis and having at least one aperture for scanning radiation from inside the first scanning element to outside the first scanning element; and b. a second scanning element constrained to motion solely with respect to a second single axis and having at least one aperture for scanning radiation that has been transmitted through the first scanning element across a region of an inspected object".

An imaging system for stationary objects that derives one axis of motion from rotation is conceptually simple but rotating the system, or a large part of it, is not only slow (typical image acquisition times would be many seconds) but also becomes mechanically challenging for larger, higher power systems.

Signal-to-noise and spatial resolution considerations dictate that in order to acquire two-dimensional backscatter images in a second or less, the imaging system must typically feature a high line rate and a powerful X-ray source. U.S. Pat. No. 8,576,989, assigned to Rapiscan Systems, Inc. discloses "a beam chopping apparatus, and more specifically, a helical shutter for an electron beam system that is employed in radiation-based scanning systems, and more specifically, a beam chopping apparatus that allows for variability in both velocity and beam spot size by modifying the physical characteristics or geometry of the beam chopper apparatus."

The highest line rates are achieved by sweeping an electron beam along a linear target and collimating the emitted X-rays with a stationary aperture. Not only can the electron beam be controlled to scan the entire length of the X-ray production target in a fraction of a millisecond, moving the beam fast across the target also distributes heat generated by the impinging electron beam and thus enables focal spots of significantly higher power densities than possible in conventional X-ray tubes.

U.S. Pat. No. 6,282,260, assigned to American Science & Engineering, Inc. which is incorporated herein by reference, discloses "a hand holdable inspection device for three-dimensional inspection of a volume distal to a surface. The inspection device has a hand-holdable unit including a source of penetrating radiation for providing a beam of specified cross-section and a detector arrangement for detecting penetrating radiation from the beam scattered by the object in the direction of the detector arrangement and for generating a scattered radiation signal."

Although conventional methods for acquiring a two-dimensional image exist, such methods do not lend themselves to fast scanning or scanning with long collimation lengths. Further, electron beam tubes with sufficiently large two-dimensional transmission targets are technically challenging and have not yet become commercially available. For high-power sources, reflection targets remain the only viable choice that can make electron beam line scanning sources practical.

Having a fast line scanner enables imaging of fast moving objects. However, for acquiring image frames of a stationary object, the beam plane must move at the desired frame rate. For sub-second image frame acquisition times, rotating the entire X-ray source and beam forming assembly is not practical or efficient.

Hence there is need for a novel method and apparatus for acquiring wide field-of-view backscatter X-ray images of stationary objects without rotating the source.

SUMMARY

The following embodiments and aspects thereof are described and illustrated in conjunction with systems, tools and methods, which are meant to be exemplary and illustrative, and not limiting in scope.

In some embodiments, the present specification may disclose a two-dimensional X-ray scanner comprising: a beam focuser and a beam steerer for scanning an electron beam on a path along an X-ray production target as a function of time; and an aperture adapted for travel in an aperture travel path relative to X-rays emitted by the X-ray production target.

Optionally, the aperture is an intersection of a fixed slit and a moving slit.

Optionally, the moving slit is adapted for rotation within a chopper wheel.

Optionally, the moving slit is aligned radially with respect to rotation of a chopper wheel about an axis.

Optionally, the X-ray production target is enclosed within a snout.

Optionally, the X-ray production target is a planar target block.

Optionally, the X-ray production target is convex.

Optionally, the two-dimensional X-ray scanner is configured to have a predefined take-off angle and wherein, during operation, the electron beam is steered to maintain the pre-defined take-off angle with the travelling aperture.

In some embodiments, the present specification may disclose a method for sweeping an X-ray beam across an object of inspection in two dimensions using a two-dimensional X-ray scanner, the method comprising: varying a direction of a beam of electrons relative to a target upon which the beam of electrons impinges; and coupling X-rays generated at the target via an aperture that moves along a prescribed path as a function of time.

Optionally, coupling X-rays generated at the target may include coupling the X-rays via an intersection of a fixed slit and a moving slit.

Optionally, the moving slit is adapted for rotation within a chopper wheel.

Optionally, the moving slit is aligned radially with respect to rotation of a chopper wheel about an axis.

Optionally, the target is enclosed within a snout.

Optionally, the target is a planar target block.

Optionally, the target is convex. Optionally, the electron beam is steered to maintain a pre-defined take-off angle with the travelling aperture.

Optionally, the two-dimensional X-ray scanner is configured to have a predefined take-off angle and wherein, during operation, the electron beam is steered to maintain the pre-defined take-off angle with the travelling aperture.

In some embodiments, the present specification may disclose a two-dimensional X-ray scanner comprising: a beam steerer for steering an electron beam to impinge upon a target; and a collimator comprising an aperture adapted for travel in an aperture travel path for rotating the electron beam impinging upon the target for emitting an X-ray beam.

Optionally, the aperture is an intersection of a fixed slit and a moving slit adapted for rotation within a chopper wheel.

Optionally, the moving slit is aligned radially with respect to rotation of the chopper wheel about an axis.

Optionally, the target is enclosed within a snout.

Optionally, the target is a planar target block.

Optionally, the target is convex.

Optionally, the electron beam is steered to maintain a pre-defined take-off angle with the travelling aperture.

Optionally, the two-dimensional X-ray scanner is configured to have a predefined take-off angle and wherein, during operation, the electron beam is steered to maintain the pre-defined take-off angle with the travelling aperture.

The aforementioned and other embodiments of the present specification shall be described in greater depth in the drawings and detailed description provided below.

BRIEF DESCRIPTION OF THE DRAWINGS

These and other features and advantages of the present specification will be further appreciated, as they become better understood by reference to the detailed description when considered in connection with the accompanying drawings.

DETAILED DESCRIPTION

Figure 1A:
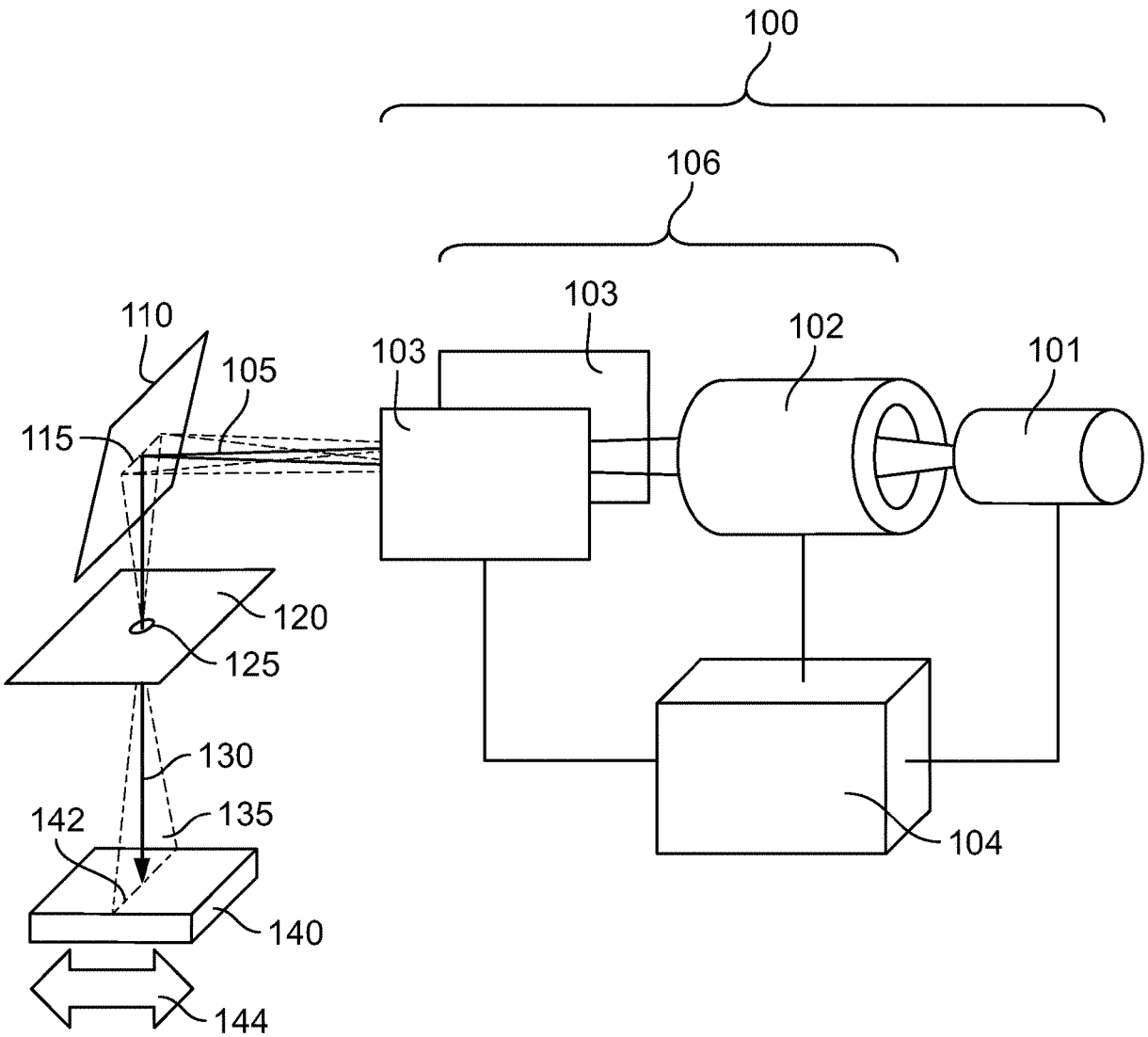
FIG. 1A is a schematic depiction of an electronic beam scanner.

In various embodiments, the present specification provides a method and apparatus for acquiring wide field-of-view backscatter X-ray images of stationary objects without rotating the source in an X-ray imaging system.

The following definitions are provided to further describe various aspects of the present specification in some embodiments:

The term "beam angle" refers to an instantaneous exit angle of a beam from a scanning device measured in relation to a center line of the angular beam span. (The beam angle, thus, varies from instant to instant as the beam is scanned.)

The term "snout" is defined as an enclosure that is opaque to the radiation in question and comprises one or more defined openings through which radiation is allowed to emerge.

The term "snout length" is defined as the normal distance between a target where X-rays are generated and an aperture within a snout from where the generated X-rays emerge from the snout. The snout length determines the system's "collimation length" (see below).

The term "collimation length" is defined as the shortest distance between the focal spot on the X-ray production target and an aperture serving to collimate an emergent X-ray beam.

The term "take-off angle" is defined as the angle between the direction of X-ray beam extraction through the aperture and the plane that is tangent to the target surface at the focal spot.

The term "scan head" encompass any structure which contains an X-ray source for two-dimensional scanning, whether by moving the scan head or in accordance with teachings of the present specification.

Where an element is described as being "on," "connected to," or "coupled to" another element, it may be directly on, connected or coupled to the other element, or, alternatively, one or more intervening elements may be present, unless otherwise specified.

The terminology used herein is for the purpose of describing particular embodiments and is not intended to be limiting. The singular forms "a," "an," and "the," are intended to include the plural forms as well.

The present specification is directed towards multiple embodiments. The following disclosure is provided in order to enable a person having ordinary skill in the art to practice the specification. Language used in this specification should not be interpreted as a general disavowal of any one specific embodiment or used to limit the claims beyond the meaning of the terms used therein. The general principles defined herein may be applied to other embodiments and applications without departing from the spirit and scope of the specification. Also, the terminology and phraseology used is for the purpose of describing exemplary embodiments and should not be considered limiting. Thus, the present specification is to be accorded the widest scope encompassing numerous alternatives, modifications and equivalents consistent with the principles and features disclosed. For purpose of clarity, details relating to technical material that is known in the technical fields related to the specification have not been described in detail so as not to unnecessarily obscure the present specification.

In the description and claims of the application, each of the words "comprise" "include" and "have", and forms thereof, are not necessarily limited to members in a list with which the words may be associated.

It should be noted herein that any feature or component described in association with a specific embodiment may be used and implemented with any other embodiment unless clearly indicated otherwise.

An electromagnetic scanner is now described with reference to FIG. 1A. A scanning electron beam X-ray source, designated generally by numeral 100, comprises an electron gun 101, a beam focuser 102 (also referred to herein as a "focus lens" 102), a beam steerer 103 (also referred to herein as "deflection module" 103), and a beam controller 104 which scans a focused electron beam 105 along a focal path 115 on an X-ray production target 110. Beam focuser 102 and beam steerer 103, alone or together, may be referred to herein as a "focus and deflection module", designated generally by numeral 106. Collimator 120, which is stationary with reference to the X-ray production target 110, contains an aperture 125, creating a scanning X-ray beam 130 that spans a beam plane 135. X-ray beam 130 may be referred to herein as X-ray pencil beam 130 without regard to the precise cross-section of the beam.

Electrons 105 emerging from gun 101 are steered by focus lens 102 and deflection module 103, governed by beam controller 104, such that electron beam 105 is scanned on a focal path 115 along X-ray production target 110 (also referred to herein as "target" 110). X-rays emitted through aperture 125 during a scan of electron beam 105 lie within a beam plane defined as the unique plane containing the focal path 115 and the aperture 125. If focal path 115 is not a straight line and/or aperture 125 is not a simple aperture but formed by a collimator as taught in U.S. Pat. Nos. 9,117,564 and 9,257,208, both assigned to American Science and Engineering and incorporated herein by reference, then X-rays emitted through aperture 125 during a scan of electron beam 105 lie on a non-planar surface. For simplicity we will still refer to the surface as a beam "plane".

An inspection object 140 is placed in the path of the beam plane 135. As the scanning X-ray beam 130 traverses the beam plane 135, scattered and/or transmitted X-rays from a scan line 142 are recorded by X-ray detectors (not shown). The inspection object 140 may be imaged by moving it successively along an axis 144 transverse to beam plane 135 while collecting scan lines. This method and apparatus is further described in U.S. Pat. No. 4,045,672, assigned to Watanabe, which is incorporated herein by reference.

Figure 1B:
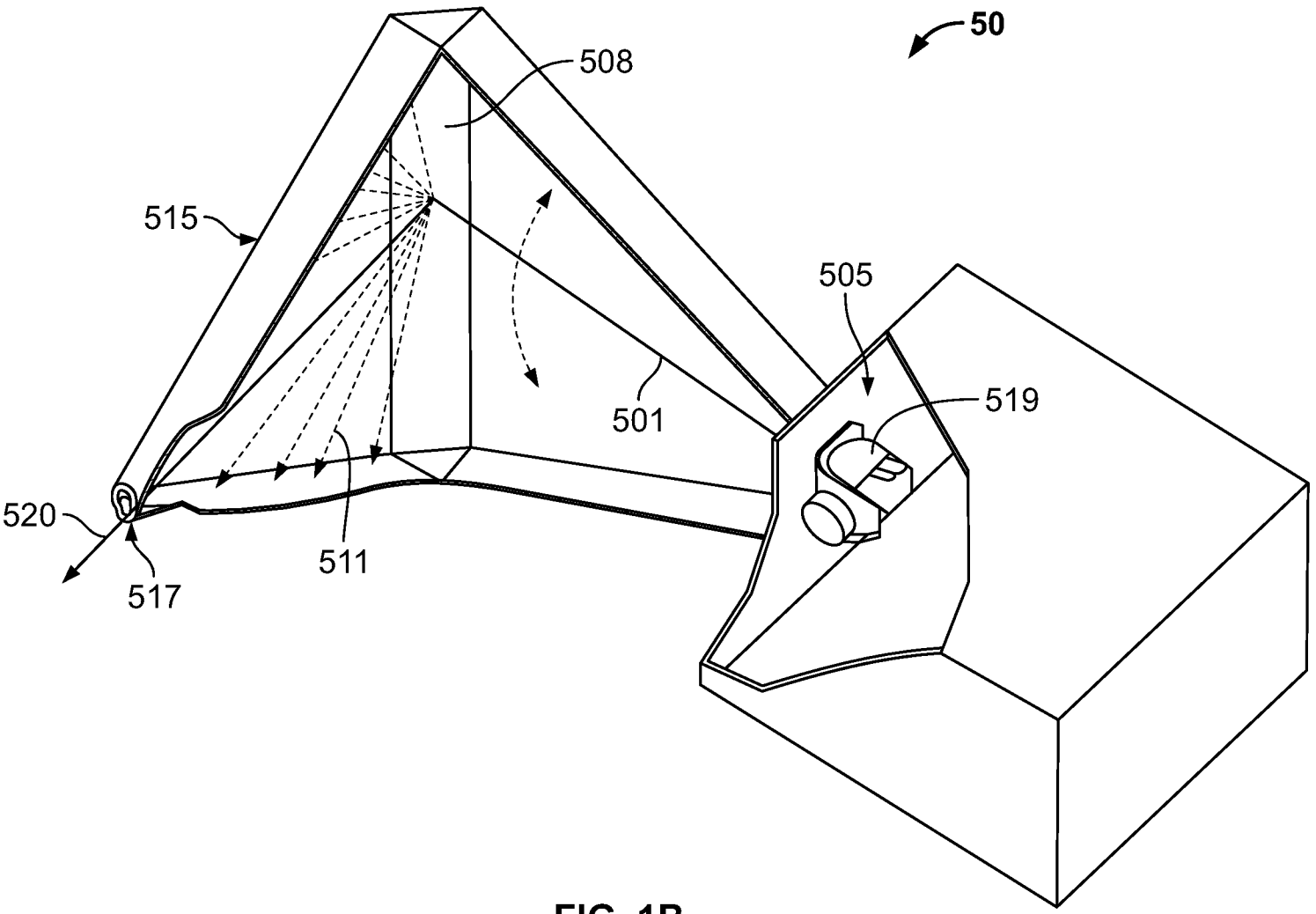
FIG. 1B depicts another electronic beam scanner.

Another electromagnetic scanner (EMS) 50 is described with reference to FIG. 1B. Electrons in an electron beam 501 are focused and steered by beam controller 505 so as to sweep over a target 508, which may optionally be water-cooled. Beam controller 505 applies electric and/or magnetic fields for confining and steering electron beam 501, and, in particular, beam controller 505 includes beam steering coil 519. The source of electrons typically is an electron gun 101 (shown in FIG. 1A) from which electrons in electron beam 501 are emitted. Impingement of electron beam 501 onto target 508 produces X-rays 511 into a snout 515 that has a single-exit aperture 517 at its apex. (The vacuum seal, or window (not shown) may be anywhere, and is typically close to target 508 to minimize the vacuum volume.) The emerging X-ray beam 520 is swept in angle as electron beam 501 is swept across target 508.

Figure 1D:
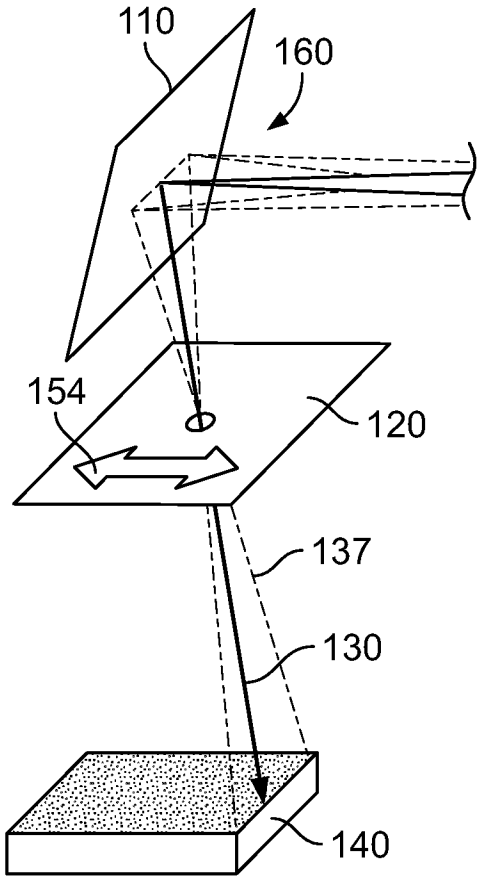
FIG. 1D schematically depicts a hybrid electromagnetic/mechanical scanning of an X-ray beam with a collimator in a second position with an increased size of the apparent focal spot, in accordance with another embodiment of the present specification.
Figure 1C:
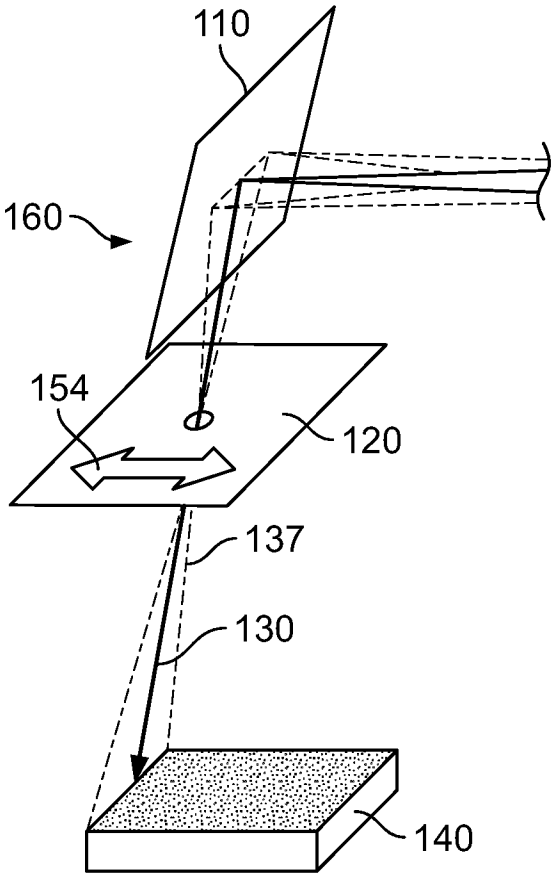
FIG. 1C schematically depicts a hybrid electromagnetic/mechanical scanning of an X-ray beam with a collimator in a first position with a limited field of view, in accordance with an embodiment of the present specification.

As described with reference to FIG. 1A, the collimator 120 of the electromagnetic scanner (such as the one shown in FIG. 1A) remains stationary during the course of inspection of an object. FIGS. 1C and 1D illustrate electromagnetic scanner embodiments 160 wherein the collimator 120 is moved during the course of the inspection process. Referring to FIGS. 1C and 1D, the movement of collimator 120 creates a sweeping beam plane 137 and allows keeping the inspection object 140 stationary with reference to the scanning electron beam X-ray source 100 (shown in FIG. 1A). In accordance with this method, the extent of the beam plane's sweep angle, and thus the field of view, may be limited by the heel effect at one end, as shown in FIG. 1C, where the intensity of the beam 130 is degraded towards one extremum of its motion due to attenuation within the X-ray production target 110 itself. At the other extremum, spatial resolution may be lost due to the increasing size of the apparent focal spot, as would occur in FIG. 1D. A practical range for the beam plane's sweep angle is 30° to 40°.

Figure 2A:
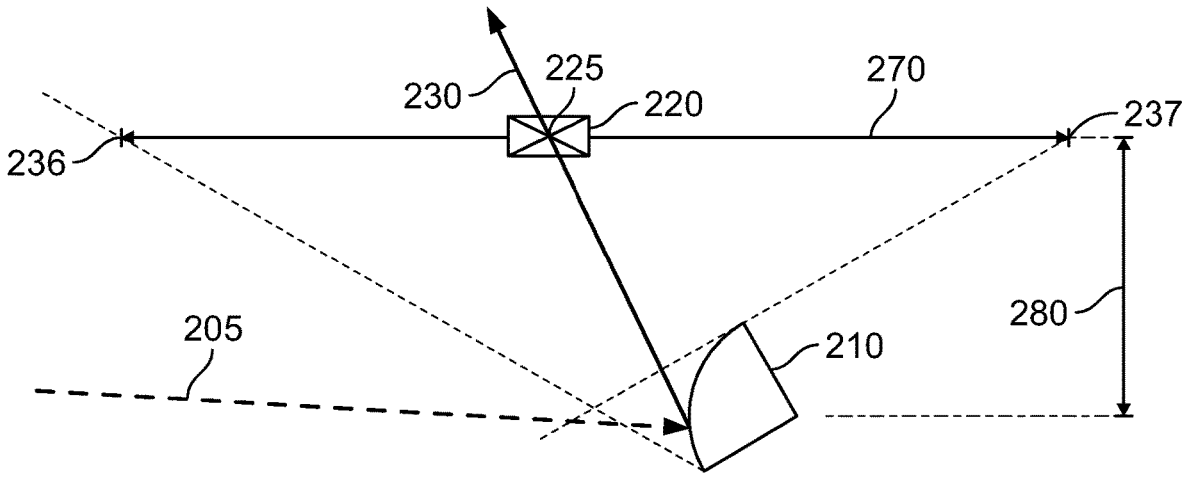
FIG. 2A depicts a planar cross-section of a hybrid electrical/mechanical scanner, in accordance with a wide-angle embodiment of the present specification.
Figure 2B:
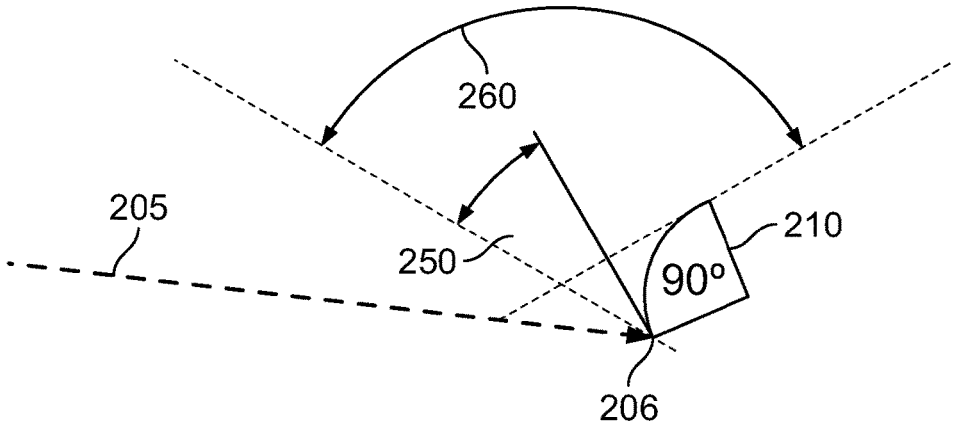
FIG. 2B shows a planar cross-section of a hybrid electrical/mechanical scanner, in accordance with the wide-angle embodiment of FIG. 2A with the electron beam striking the target at a different location.
Figure 2C:
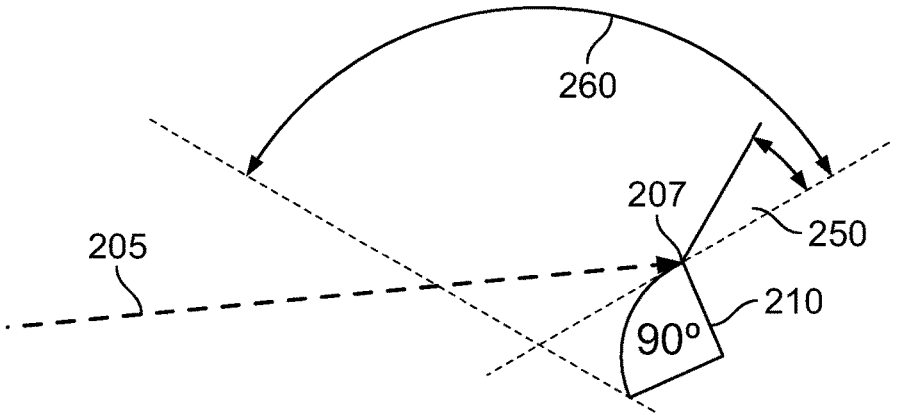
FIG. 2C shows a planar cross-section of a hybrid electrical/mechanical scanner, in accordance with a wide-angle embodiment of FIG. 2A with the electron beam striking the target at a different location.

FIG. 2A depicts a planar cross-section of a hybrid electrical/mechanical scanner, in accordance with a wide-angle embodiment of the present specification. In embodiments, the term 'wide-angle' is used to denote an angle exceeding the aforementioned range of 30° to 40° by a factor ranging from two to three. In an embodiment, the angle may be 120° as depicted in FIGS. 2A, 2B and 2C. Focused, steered electron beam 205 impinges upon X-ray production target 210. Successive lines are generated by moving collimator 220 having an aperture 225 (wherein the beam plane moves with aperture 225), along aperture travel path or range 270 (also referred to herein as "lateral travel" 270) which extends from a first end or outer boundary 236 of the beam plane to the second end or outer boundary 237, as shown in FIG. 2A, whereby scanning X-ray beam 230 emerges from aperture 225. It should be appreciated that the beam plane is perpendicular to FIG. 2A and therefore its projection onto FIG. 2A is the X-ray beam 230. Since the beam emerges from the aperture, it must also move with the aperture.

The beam plane is turned or rotated incrementally by moving aperture 225. The aperture travel range is designated by the extrema (or outer bounds) ranging from a first end 236 of the beam plane to the second end 237, while the nominal snout length is designated by numeral 280. While in FIGS. 1C and 1D the axis of rotation for the beam plane is the focal path 115 (shown in FIGS. 1A, 1B) on the X-ray production target 110, the wide angle embodiment depicted in FIG. 2A does not feature a simple rotational axis for the beam plane. Instead the beam plane is approximately tangent to the convex X-ray production target 210. The time needed for the aperture 225 to travel its path 270 constitutes the image frame acquisition time. Accordingly, frame rates fast enough for backscatter motion imaging become advantageously possible.

Referring to FIGS. 1C and 1D, when using a flat (planar) X-ray production target 110, the angular range (which has an identical meaning, herein, to the term "angular span", and corresponds to the range over which the beam plane rotates, i.e., the angular extent of motion of the beam plane) between the beam planes depicted in FIGS. 1C and 1D depends on the so-called 'heel effect,' as in cone beam imaging with film or a flat panel detector. By virtue of the heel effect, the intensity of the beam 130 is degraded towards the extreme of its motion due to attenuation within the target 110 itself. Typically, 30° to 40° of angular range are used with the take-off angle starting at about 1°. The other limit is due to the enlargement of the apparent focal spot and the associated loss in spatial resolution.

Referring to FIGS. 1C and 1D, assuming a 12" (300 mm) snout length, a 500 mm long focal track will create an angular beam span of about 80° in the beam plane 137. Assuming a planar target with a 40° angular range for the take-off angle and thus the beam plane, this EMS would cover a 4'4" (1.31 m) wide and 8'4" (2.5 m) high image at 5' (1.5 m) from the collimator. With a 12" (300 mm) snout length (as defined above), the lateral travel path 154 (i.e. the vertical path of the electron beam's focal spot on the target) of the aperture needs to be 8.6" (218 mm). Therefore, for certain snout lengths, an angular beam span range of 40 to 80 degrees may be achieved by a have a track length of 150 mm to 600 mm, preferably 200 mm to 500 mm.

In one embodiment of the present specification, aperture 225 is made to travel on an arc with the X-ray production target 210 at its center in order to maintain angular alignment. In an embodiment, the radius of the arc is approximately 12". In an embodiment, an X-ray transparent floater is used in an arc shaped mercury filled pipe to enable the aperture travel on an arc hydraulically, wherein the mercury blocks the X-rays and the floater forms the aperture.

Since the position of electron beam 105/205 on target 110/210 can be easily controlled using an X-Y deflection module (similar to deflection module 103 shown in FIG. 1A), converting from a conventional, flat production target 110 (shown in FIGS. 1C and 1D) to a target 210 with a convex surface allows extending the angular range. While the simplest convex surface is cylindrical, other convex shapes may be employed within the scope of the present specification. As is known, the limiting heel angle is with reference to the tangential plane at the focal track, and a convex shape provides a range of tangential planes depending upon the positioning of the focal track.

FIGS. 2A, 2B and 2C show planar cross-sections of a hybrid electrical/mechanical scanner, in accordance with other wide-angle embodiments of the present specification. Referring to FIGS. 2A, 2B and 2C, by using a conservative 30° take-off range 250 from a quarter-round target 210 creates a 120° angular range 260, as shown in FIGS. 2B and 2C, where FIG. 2B shows the steered electron beam 205 strike the target 210 at a first outer boundary 206 and FIG. 2C shows the steered electron beam 205 strike the target 210 at a second outer boundary or extrema 207. The aperture 225 would be near extremum 236 for the electron beam deflection shown in FIG. 2B and near extremum 237 for the electron beam deflection shown in FIG. 2C. The electron beam is steered so that a desired take-off angle is maintained. Accordingly, the focal track is moved with the aperture to maintain the desired take-off angle.

Hence, in various embodiments, by moving the comparably small collimator and not the entire X-ray source, the field of view of an X-ray imaging system can be increased by a factor of 3 or more over that of a conventional, heel-effect-limited X-ray source. This would, however, necessitate a fairly large X-ray exit window and the moving aperture 225 would have to travel linearly $2\sqrt{3}$ times the snout length 280. For a 150-mm snout length the aperture 225 would have to travel linearly over a distance of approximately 520 mm to achieve a 120° angular range. If only a 90° angular range is needed, aperture 225 must travel twice the snout length 280. Accordingly, a curved travel path may be preferable.

Figure 3A:
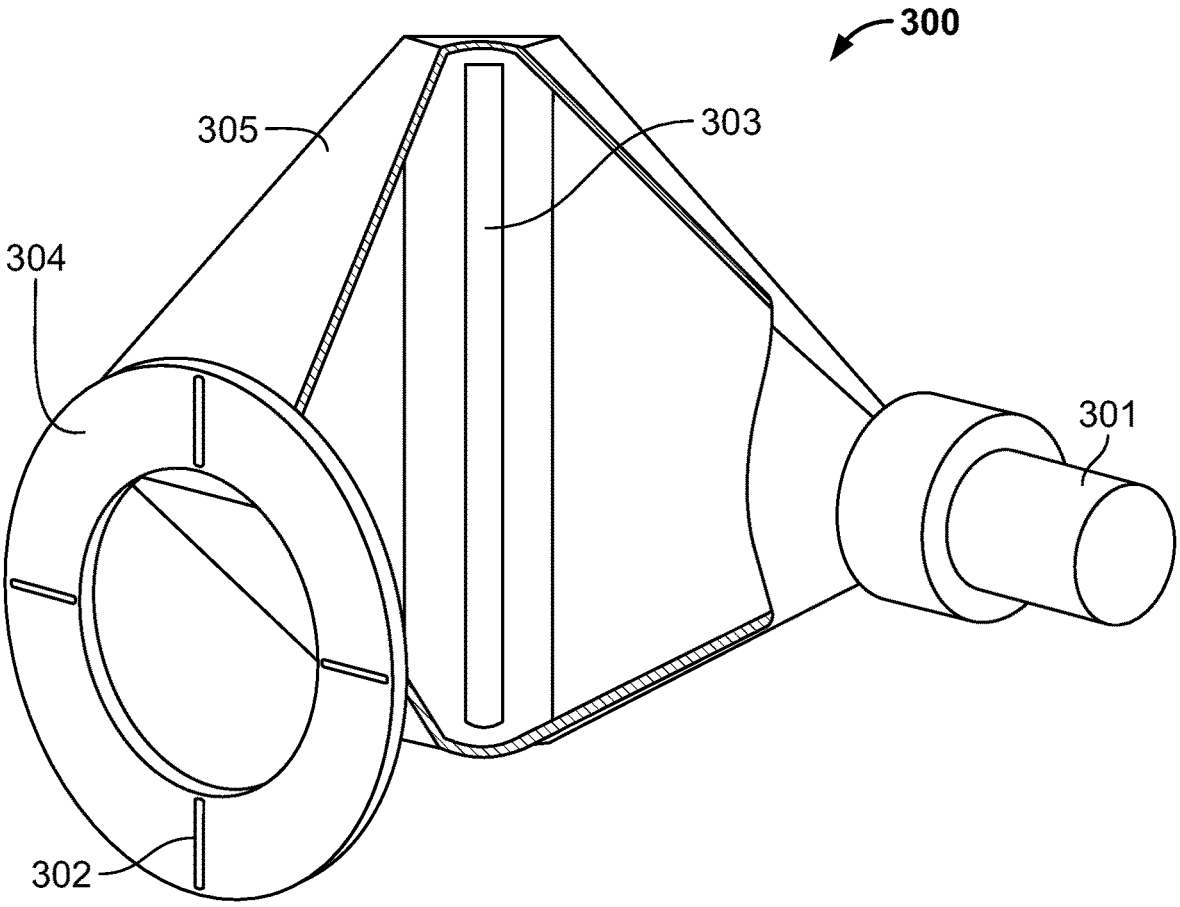
FIG. 3A is a perspective view of a two-dimensional scanning X-ray source cut away to show a convex target, in accordance with an embodiment of the present specification.

An embodiment of a two-dimensional scanner, designated generally by numeral 300, is shown in perspective in FIG. 3A. A scanning aperture (such as aperture 225 in FIG. 2A) is achieved by rotating slits 302 of chopper disk 304 across X-ray beam window 310, which is shown with chopper 304 removed in FIG. 3B. Slit 302 is an example of a moving slit. Electrons from source 301 scan a target block 303 (which may be planar, or convex, as shown), with Bremsstrahlung X-rays confined by snout 305 to emerge only at the aperture created where rotating slit 302 intersects with X-ray beam window 310. X-ray beam window 310 is an example of a fixed slit. In the embodiment shown in FIG. 3A, rotating slit 302 is aligned radially with respect to an axis of rotation (not shown) of chopper disk 304 as one example.

Figure 3B:
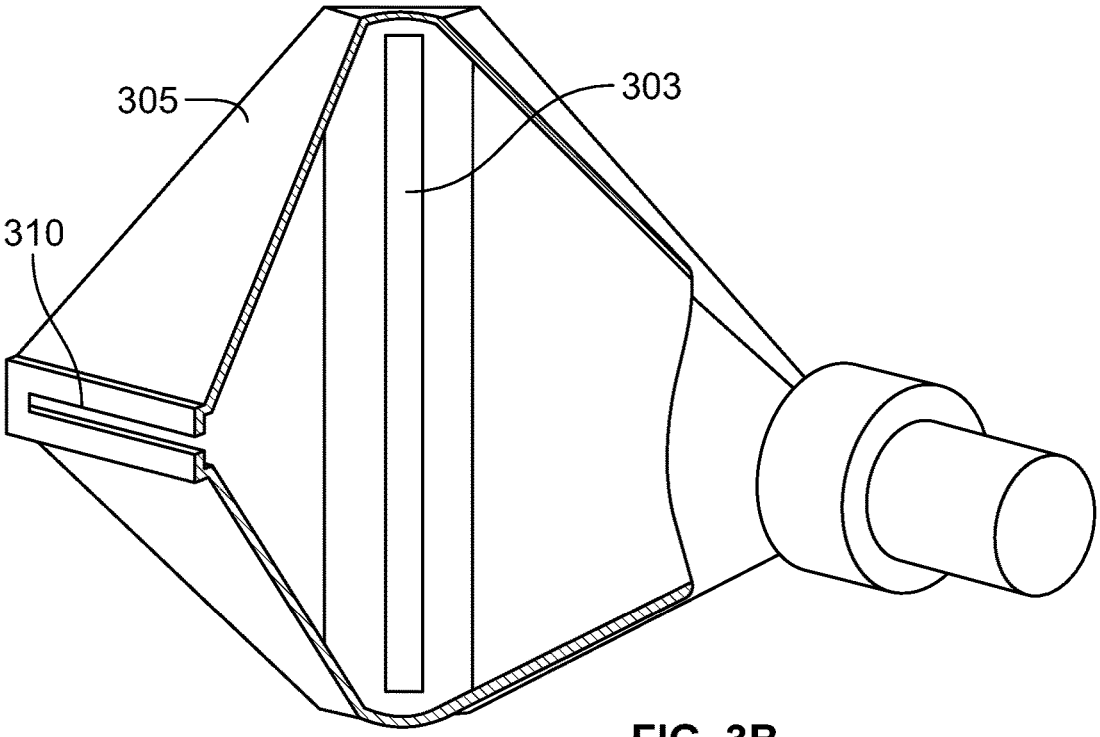
FIG. 3B is a perspective view of the X-ray source of FIG. 3A, with a chopper wheel cut away in order to show an X-ray beam window, in accordance with an embodiment of the present specification.

FIG. 3B is another depiction of the X-ray source of FIG. 3A, cutaway to show convex target 303 and X-ray beam window 310. The breadth of X-ray window 310 defines the line of pivot points for the X-ray beam as the electron beam scans along the target and thus creates the fast scan lines. The breadth of X-ray window 310 depends upon the desired field of view, and in an embodiment, is approximately equal to the lateral travel path 270. In another embodiment, the breadth dimension of the X-ray window is within ten percent (10%) of the lateral travel path dimension. The rate of angular change of the beam plane caused by moving the aperture is much slower.

Scanning with chopper disk 304 for rotating apertures/slits 302 across X-ray beam window 310 is one way to achieve the moving aperture 225 (shown in FIG. 2A), and is suitable when the system does not require a large beam angle. Other ways of implementing a moving aperture are within the scope of the present specification, and the following examples are provided without limitation: a rotating twisted slit collimator, variations of which are described in U.S. Pat. Nos. 4,745,631, 4,995,066, and 5,038,370, assigned to Philips Corp. and European Patent No. 1,772,874, assigned to Bundesanstalt für Materialforschung and Prufung (BAM), all of which are incorporated herein by reference; translating an aperture like the twisted slit described in U.S. Pat. Nos. 9,117,564 and 9,257,208 assigned to American Science and Engineering, Inc. (both incorporated herein by reference), with an actuator linear motor; and a hoop with parallel slits rotating with respect to a common axis of rotation.

Embodiments of a two-dimensional scanner, in accordance with the foregoing teachings, may advantageously provide fast two dimensional image acquisition, with imaging at a rate of multiple frames per second made possible for the first time. The field of view provided by systems enabled hereby may be multiple times the field of view of a stationary tube system in size. Thus, 120° azimuth is now possible, vs. current limits of 30°-40°.

A stationary two-dimensional scanner in accordance with the foregoing teachings may be particularly useful in situations that require a scanner that is compact in the lateral direction, or where it is important to operate close to the target without risk of accidentally contacting the target, or where movement of the scan head could be problematic for the platform on which the scan head is mounted. Examples, provided without limiting intent, include: inspecting aircraft, where any accidental collision renders the aircraft legally non-airworthy until a certified mechanic can inspect the aircraft to verify that no damage has been done; inspecting suspected improvised explosive devices (IEDs), where any accidental contact could detonate the IED; inspection of IEDs or any other application using a robot mounted imaging system. Space on a robotic vehicle is typically very limited, and a shifting or even rotating scanner might change the center of balance of the entire assembly which can be a problem, particularly on uneven terrain; medical X-ray applications, where the scanner must operate in close proximity to the patient without touching the patient or interfering with medical personnel working on the patient.

Eliminating the need to move the scanner is also helpful in cases where high precision of beam placement is needed. Examples, provided without limiting intent, include: imaging at a distance, where small movements could translate to large position errors of the beam; Non-Destructive Testing (NDT) applications which often require very high resolution; NDT and Explosive Ordnance Disposal (EOD) applications which might use the image data for precision measurements of the target. EOD systems might use the measurement results to help aim a disruptor, or for forensic work, in addition to simply detecting the presence of an IED; applications which sum data from multiple repeat 'frames' to build up image statistics over a period of time (also likely for NDT or EOD applications).

It should be noted that the formation and scanning of X-ray pencil beam may be employed for any manner of imaging, such as transmission, sidescatter, or backscatter imaging, for example, within the scope of the present specification.

The above examples are merely illustrative of the many applications of the system and method of present specification. Although only a few embodiments of the present specification have been described herein, it should be understood that the present specification might be embodied in many other specific forms without departing from the spirit or scope of the specification. Therefore, the present examples and embodiments are to be considered as illustrative and not restrictive, and the specification may be modified within the scope of the appended claims.

We claim:

1. A two-dimensional X-ray scanning system comprising:

an X-ray scanner comprising:

a beam focuser;

a beam steerer for scanning an electron beam on a path along an X-ray production target as a function of time; and an aperture adapted for travel in an aperture travel path relative to the X-ray production target, wherein the X-ray scanner remains stationary with respect to the object of inspection; and a detector configured to detect X-rays passing through an object or scattered by the object of inspection and generate two-dimensional data indicative of the detected X-rays.

2. A The two-dimensional X-ray scanning system of claim 1, wherein the aperture is an intersection of a fixed slit and a moving slit.

3. The two-dimensional X-ray scanning system of claim 1, wherein the X-ray production target is a planar target block.

4. The two-dimensional X-ray scanning system of claim 1, wherein the X-ray production target is convex.

5. The two-dimensional X-ray scanning system of claim 4, wherein the X ray scanner is configured to have a predefined take-off angle and wherein, during operation, the electron beam is steered across the convex X-ray production target to maintain the pre-defined take-off angle with the travelling aperture.

6. A method for sweeping an X-ray beam across an object of inspection in two dimensions using a two-dimensional X-ray scanner wherein the X-ray scanner is configured to remain stationary with respect to the object of inspection, the method comprising:

varying a direction of a beam of electrons relative to a target upon which the beam of electrons impinges; and coupling X-rays generated at the target via an aperture that moves along a prescribed path as a function of time.

7. The method in accordance with claim 6, wherein coupling X-rays generated at the target may include coupling the X-rays via an intersection of a fixed slit and a moving slit.

8. The method in accordance with claim 6, wherein the target is a planar target block.

9. The method in accordance with claim 6, wherein the target is convex.

10. The method in accordance with claim 9, wherein the two-dimensional X ray scanner is configured to have a predefined take-off angle and wherein, during operation, the electron beam is steered across the convex X-ray production target to maintain the pre-defined take-off angle with the travelling aperture.

11. A two-dimensional X-ray scanner comprising:

a beam steerer for steering an electron beam to impinge upon a target and thereby emit an X-ray beam; and a collimator comprising an aperture adapted for travel in an aperture travel path in order to rotate the electron beam impinging upon the target while maintaining an angular alignment with the target, wherein the two-dimensional X-ray scanner is configured to remain stationary relative to an object under inspection.

12. The two-dimensional X-ray scanner in accordance with claim 11, wherein the target is a planar target block.

13. The two-dimensional X-ray scanner in accordance with claim 11, wherein the target is convex.

14. The two-dimensional X-ray scanner in accordance with claim 13, wherein the two-dimensional X ray scanner is configured to have a predefined take-off angle and wherein, during operation, the electron beam is steered across the convex X-ray production target to maintain the pre-defined take-off angle with the travelling aperture.

* * * * *